US006253830B1

(12) United States Patent
Bickford et al.

(10) Patent No.: US 6,253,830 B1
(45) Date of Patent: Jul. 3, 2001

(54) APPARATUS AND METHOD FOR SAND CORE DEBONDING AND HEAT TREATING METAL CASTINGS

(75) Inventors: Karin Staffin Bickford, Princeton; Herbert Kenneth Staffin, Colonia; Robert Bernard Roaper, II, Martinsville, all of NJ (US)

(73) Assignee: Procedyne Corp., New Brunswick, NJ (US)

( * ) Notice: Subject to any disclaimer, the term of this patent is extended or adjusted under 35 U.S.C. 154(b) by 394 days.

(21) Appl. No.: 08/724,542

(22) Filed: Sep. 30, 1996

(51) Int. Cl.[7] ..... B22D 29/00
(52) U.S. Cl. ..... 164/132; 164/5; 266/252
(58) Field of Search ..... 164/5, 131, 132, 164/404; 266/251, 252, 257; 148/710

(56) References Cited

U.S. PATENT DOCUMENTS 5,294,094 * 3/1994 Crafton et al. ..... 164/132 X
5,332,139 * 7/1994 Heath et al. ..... 266/252 X
5,423,370 * 6/1995 Bonnemasou et al. ..... 164/132

FOREIGN PATENT DOCUMENTS

2448573 * 10/1980 (FR) ..... 266/252
63-108941 * 5/1988 (JP) ..... 164/404

* cited by examiner

*Primary Examiner*—Kuang Y. Lin
(74) *Attorney, Agent, or Firm*—Pitney, Hardin, Kipp & Szuch, LLP

(57) ABSTRACT

A process for removing sand cores from metal castings in a continuous or semi-continuous procedure utilizes a fluid bed furnace. The thermally decomposed sand cores are carried away with the fluidized solids of the furnace bed.

18 Claims, 3 Drawing Sheets

APPARATUS AND METHOD FOR SAND CORE DEBONDING AND HEAT TREATING METAL CASTINGS

BACKGROUND OF THE INVENTION

1. Field of the Invention

The invention relates to the field of ferrous and nonferrous metal casting and in particular to the debonding and removal of sand cores from cast parts, and in some cases, the heat treating of the cast parts in conjunction with the removal of sand cores.

2. Brief Description of Related Art

In the casting of ferrous and nonferrous metals into parts, the foundries in the United States consumed 7.7 million tons of foundry sand in the year 1988 alone. The steel foundries and many of the gray iron foundries use high purity (over 98% by wt. $SiO_2$) silica sand for casting molds. Many of the automotive foundries use a less pure (over 93% by wt. $SiO_2$) silica sand. Most of this sand is used by the foundries for molding or core making. When making molds or cores, a binder material is added to the foundry sand to form the mold or the core. In general, the mold forms the outside surfaces of the casting, while the cores form the inside surfaces and paths. The cast part is formed by pouring the molten ferrous or nonferrous metal into the mold. When the part has internal openings or paths, the molten metal is poured into the volume between the mold and the core(s) usually surrounding some or most of the core. When the metal solidifies, the mold is opened and the part is removed. In most cases, the core remains in the interior regions its presence has formed and must be removed.

Removal of the cores is usually accomplished by impact and vibration devices, and/or by heating to destroy the binders and/or manually by breaking and prying out of the cores. The cores are generally broken into smaller pieces within the part and can be removed through various part openings. The degree of difficulty of doing this "sand core debonding" depends upon the geometry of the part being cast and the temperature of the metal melt.

In the case of casting parts of aluminum or aluminum alloys, it is particularly difficult to remove the sand core because of the lower casting temperature used. A lower interface temperature, usually results in less separation of the sand core from the aluminum part. The aluminum also is a softer material and more prone to damage if physical impact is used in the debonding and removal process. In addition, it is necessary to cool the aluminum part substantially before any attempt is made to debond and remove the sand core by any reasonable physical means, or the part will be damaged by even modest handling.

When heating methods are used to remove sand cores by thermal destruction of the binder systems, heating cycles are typically long, 4 to 10 hours, and the removal of the core is frequently incomplete. Pieces of sand core remain where the heating process did not effectively thermally decompose all parts of the sand core. Additionally, sand core material removed from the castings must be disposed of or reclaimed. Disposal has become increasingly expensive because the binder residue is usually classified as a hazardous and/or toxic waste which must be handled accordingly. Reclamation of the foundry sand through physical and thermal processing steps is receiving increasing attention, but also involves a significant cost.

U.S. Pat. No. 5,423,370, which is incorporated herein by reference, describes the invention of a fluid bed furnace for the removal of sand cores from castings, employing a thermal process based on the use of fluidized sand of the same type as used to make the sand core. This same patent describes the use of the fluid bed furnace for the heat treating of the aluminum castings. This fluidized sand thermal process eliminates the major disadvantages associated with conventional sand core debonding processes.

However, the invention described in U.S. Pat. No. 5,423,370, depicts practicing the process using a batch fluid bed process; i.e., the parts being processed are placed in or on a basket or containing fixture and are then submerged in the fluidized solids at a suitable temperature for a suitable period of time to pyrolyze and/or otherwise thermally decompose the sand core binder thereby releasing this sand to flow freely into the fluidized bed and ultimately be recovered and reused.

For applications involving high volume processing of parts, the casting machines are typically designed to form the casting by a relatively short cycle repetitive casting operation.

The use of a batch fluid bed furnace or furnaces to perform the sand core debonding and/or simultaneous or subsequent heat treating operations exhibits the following disadvantages:

a) After the parts are cast, they are introduced into fixtures or baskets until these holding devices are filled to their capacity, where upon the fixtures or baskets containing the parts are submerged in the fluid bed furnace for the time required to accomplish the processing objectives.

This requires the first parts entering the fixture or basket to wait until the loading of the basket or fixture is completed thereby losing heat during this waiting period. The average temperature of the parts in the loaded fixture is considerably lower than their temperature when they leave the casting machine. This represents energy inefficiency with respect to a following thermal process for sand core debonding and heat treating.

b) In typical applications of high volume processing of castings, the casting machines are delivering parts to the process at a uniform cycle time. The requirement to receive a load of parts, to open the fluid bed furnace cover and load the parts, then close the furnace cover, adds time to the processing cycle time; thereby increasing the cost of the process.

In addition, the uniform conveying of the parts through the casting process is interrupted by the batch nature of the fluid bed furnaces and would be more effectively served by a continuous or semi-continuous flow of product through a continuous or semi continuous fluid bed furnace for sand core debonding and heat treating.

This invention involves the use of a continuous or semi-continuous fluid bed furnace for sand core debonding of ferrous and nonferrous castings with or without subsequent heat treatment. This invention eliminates the disadvantages of the older non-fluidized bed processes as well as those of the batch fluid bed furnace, achieving a more effecting processing system with respect to operating cost as well as processed part quality.

SUMMARY OF THE INVENTION

The invention comprises a continuous or semi-continuous method or process of removing sand cores from a metal part cast in a mold which includes a bonded sand core to form an internal passage, and when required, heat treating the casting simultaneously with or subsequently to the sand core removal, which comprises;

subjecting the part containing the sand core to a temperature sufficient to pyrolyze or otherwise thermally decompose the sand core bonding system, in a fluid bed furnace equipped with a conveyor which moves the parts on a continuous or semi-continuous basis, through the furnace;

and, in cases where the sand core removal is followed by heat treating of the parts, the heat treating process is conducted in this same fluid bed furnace and/or in a heated volume following this furnace or in the freeboard of this furnace above the fluidized bed of solids.

This method of operation provides a means to remove sand cores and when required, to heat treat cast parts economically at high production volumes with more uniform product quality and lower labor costs. The fluidized sand recovered from the process can be recycled for further foundry use.

DETAILED DESCRIPTION OF THE PREFERRED EMBODIMENTS OF THE INVENTION

Figure 1:
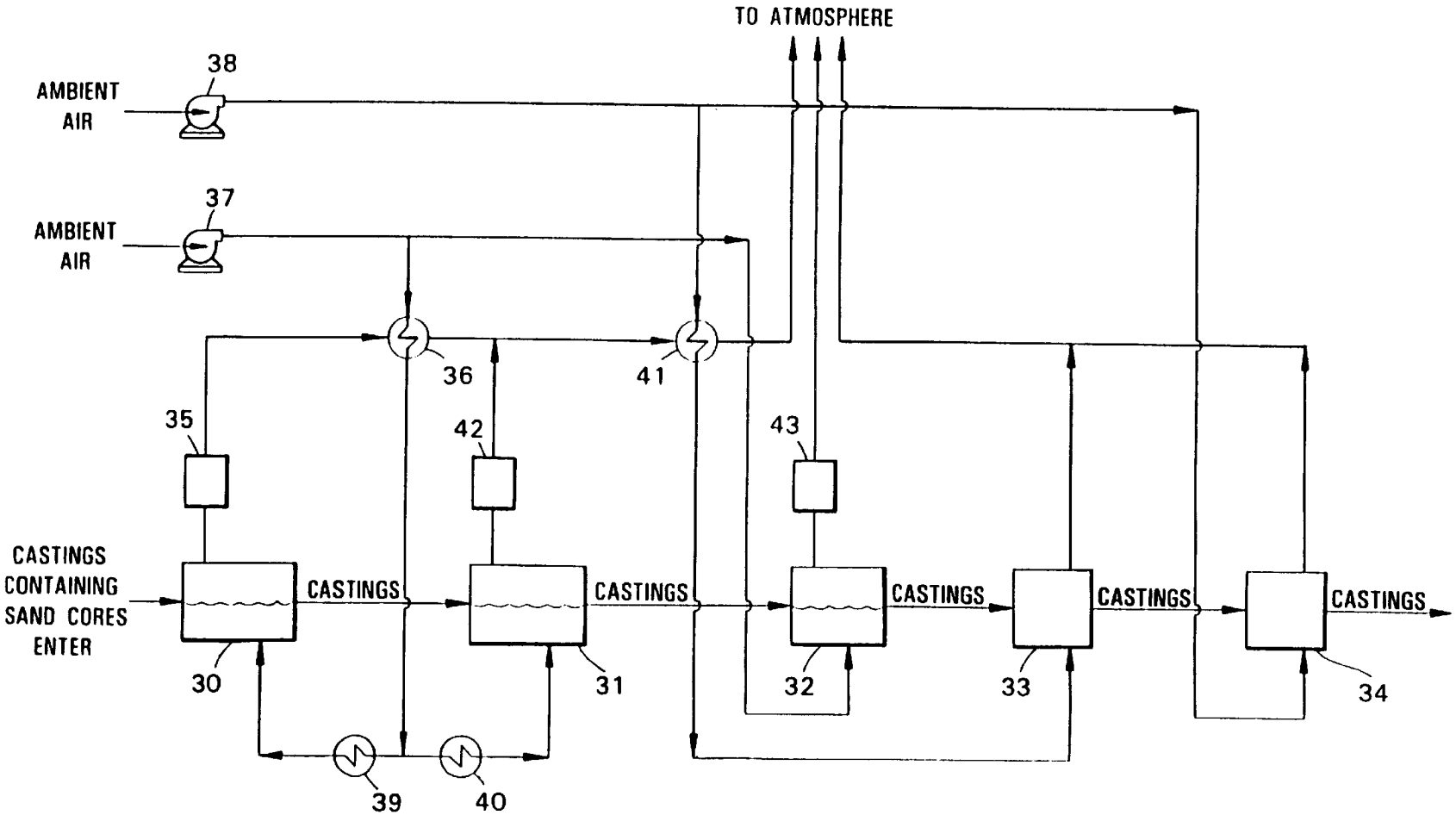
FIG. 1 is a diagrammatic scheme showing the overall process of the invention. In some cases, one or more of the steps shown are not required to achieve desired results.
Figure 2:
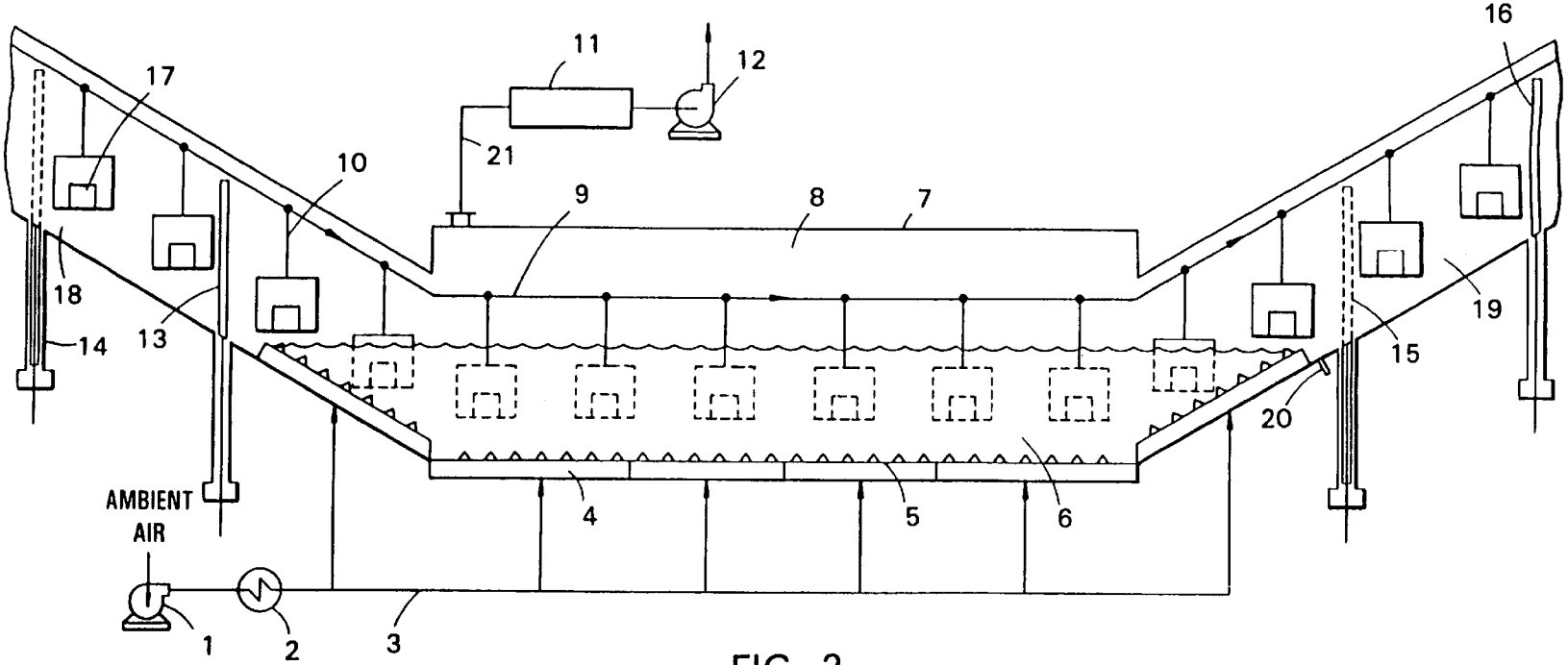
FIG. 2 is cross-sectional side elevation of a fluid bed furnace used in the process of the invention for the case of sand core removal only, or used in the process of the invention for the case of sand core removal and a simultaneous or subsequent heat treatment.
Figure 3:
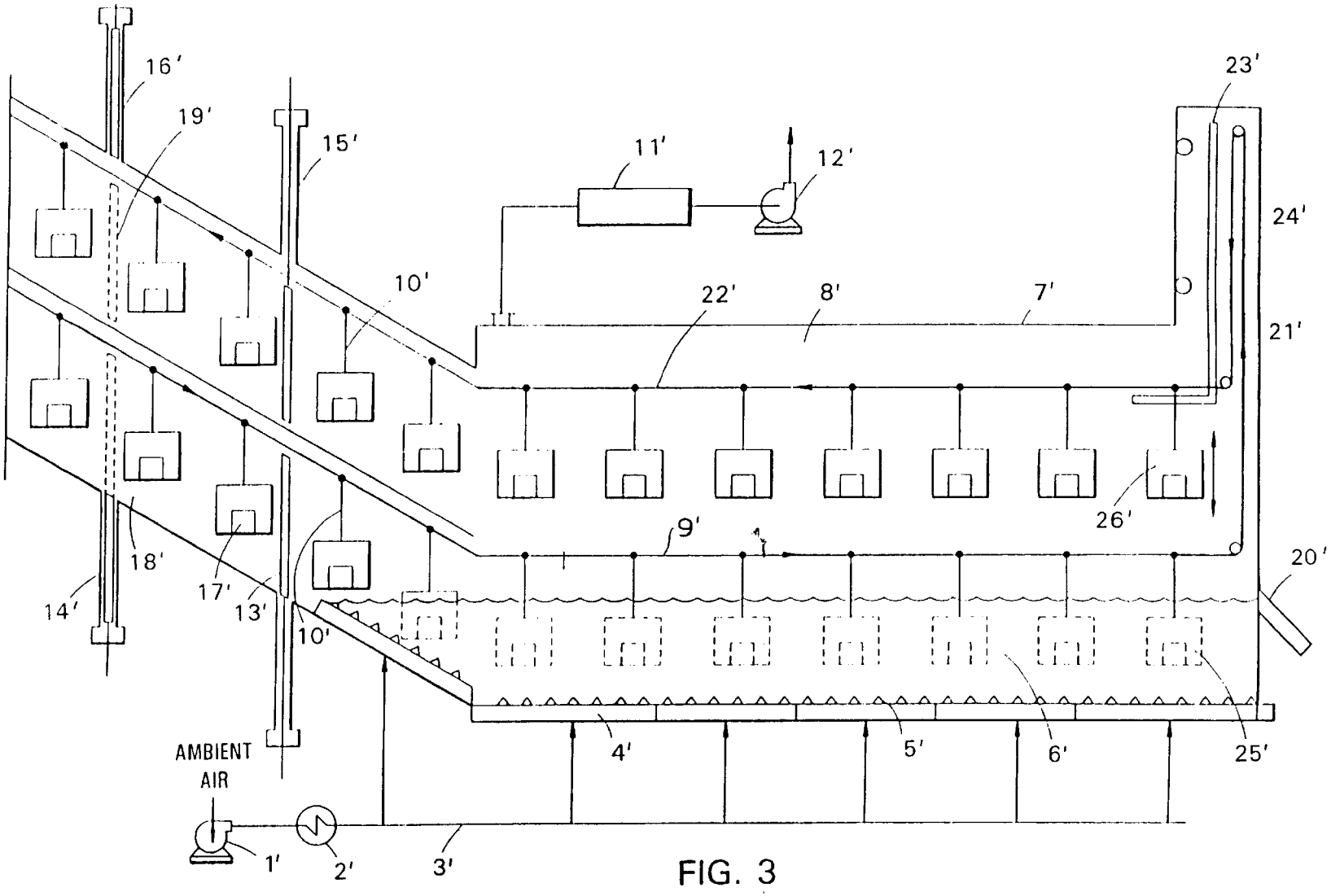
FIG. 3 is cross-sectional side elevation of a fluid bed furnace used in the process of the invention for the case of sand core removal plus heat treating where the fluid bed freeboard is used as a heated volume for processing.

Those skilled in the art will gain an appreciation of the invention from a reading of the following description of the preferred embodiments when viewed with the accompanying drawings of FIGS. 1, 2, and 3.

FIG. 1 shows the various steps typically involved in the continuous or semi-continuous sand core removal and heat treating of typical aluminum castings, involving the process of the invention. Furnace 30 is the sand core removal unit using a thermal process involving a fluid bed furnace. The typical operating temperature range of the fluidized solids is 430° C. (806° F.) to 520° C. (968° F.) and processing time is typically 30 minutes to 2 hours, depending upon the complexity of the cast part and the bonding agent of the sand cores involved.

Annealing furnace 31 is a heat treating step referred to as "solution annealing" involving a fluid bed furnace. The typical operating temperature is in the range of 490° C. (914° F.) to 520° C. (968° F.) and processing time is typically 2 to 10 hours depending upon the required properties of the cast part and the precise composition of the aluminum used to cast the part.

Quench vessel 32, is the cooling step referred to as "quenching" involving a fluid bed quench. The typical operating temperature of the fluid bed quench is in the range of 100° C. (212° F.) to 200° C. (392° F.); and, the typical quench process involves cooling the part from its solution annealing processing temperature to approximately 200° C. (392° F.), in a time within the range 0.5 to 10 minutes depending on the required properties of the cast part and the precise composition of the aluminum used to cast the part.

Aging furnace 33, is the heat treating step referred to as "aging", involving a fluid bed furnace or convective furnace. The typical operating temperature is 200° C. (392° F.), and the processing time is typically 2 to 10 hours depending upon the required properties of the cast part and the precise composition of the aluminum used to cast the part.

The final chamber 34, is the cooling of the parts to facilitate handling from the process. This is typically accomplished by a convective cooling chamber or natural convective cooling in ambient air.

A typical strategy for the ambient air input to the system, the energy inputs, the energy recovery and the discharge to the atmosphere is also shown diagrammatically in FIG. 1 for a typical aluminum casting operation involving the process of the invention.

Ambient air is compressed by blower 37, passed through heat exchanger 36, then through air heater 39, and becomes the fluidizing air for sand core removal fluid bed furnace 30. Another branch of this air from heat exchanger 36, is passed through air heater 40, and becomes the fluidizing air for solution annealing furnace 31. These high temperature fluidizing air lines typically in the temperature range of 520° C. (968° F.) to 650° C. (1202° F.), provide the energy input to maintain and control these two fluid bed furnaces at their respective required operating temperatures, by control of the energy inputs into air heaters 39 and 40. This energy input is typically provided by electric resistance heaters or by natural gas burners in the air heaters.

Another branch of the air from blower 37, is fed unheated to fluid bed quench vessel 32, and it becomes the fluidizing air in this fluid bed quench vessel. The temperature of the fluid bed in quench vessel 32, is typically maintained and controlled at required temperature using water cooled pipes submerged in the fluidized solids of the bed.

Ambient air is compressed by blower 38, passed through heat exchanger 41, and is fed to convective aging oven 33, where it becomes the controlled temperature convective air that maintains the parts being processed at the required temperature to achieve the aging treatment.

Ambient air blower 38, also feeds unheated air to cooling chamber 34, which discharges to the atmosphere.

Fluidizing off-gas discharging from the fluidized bed in furnace 30 is passed through a purification system 35, typically a cyclone and afterburner, to remove particulates and organic contamination from the sand core pyrolysis step, then through heat exchanger 36, for energy recovery, then through heat exchanger 41, for additional heat recovery and then discharges to the atmosphere.

Fluidizing off-gas discharging from furnace 31 through a purification system 42, typically a cyclone for particulate removal, combines with that discharging from furnace 30 at a point after heat exchanger 36 and the combined streams are then passed through heat exchanger 41 for additional heat recovery and then discharges to the atmosphere.

Fluidizing off-gas from fluid bed quench vessel 32, is passed through a purification system 43, typically a cyclone for particulate removal, and is discharged to the atmosphere.

Off-gas from aging furnace 33, is discharged to the atmosphere as is the off-gas from cooling chamber 34.

A typical strategy as described above accomplishes both the benefits of high energy efficiency as well as meeting the requirements of stringent atmospheric emission standards.

Referring to FIG. 2, there is seen diagrammatically a typical continuous or semi-continuous thermal process for carrying out the process of the invention with respect to sand core removal. This is a typical example of the invention. This method can be practiced with other configurations of furnace and/or mechanical conveyors.

A fluidized bed furnace, 7, is equipped with a continuous conveyor, 9, which can be a chain type or any of the conveyors of this general category. The conveyor is conveying baskets or fixtures, 10, which are capable of holding the castings 17, and moving them singly or in groups continuously, or cyclically (semi-continuously) through the furnace in a uniform manner and at a linear speed which is adjusted to achieve the required residence time of the parts in the furnace.

The parts enter the furnace, vestibule 18, through a door 14, which can be automatically opened and closed. After door 14 is closed, the following door, 13, opens to allow the basket or fixture 10 to leave the vestibule 18, and enter the furnace volume, 8. These feed doors 14 and 13 keep alternately opening and closing as conveyor 9 moves the successive line of baskets or fixtures through the furnace to the discharge vestibule 19.

The parts exit the furnace into the discharge vestibule 19, through door 15.

After the discharging basket or fixture 10 enters the discharge vestibule 19, door 15 closes and door 16 opens to allow the basket or fixture to exit the vestibule 19, and continue to the next processing step for the castings or to an unloading area where the casting 17 is removed from the basket or fixture, if this process only involves sand core debonding. These discharge doors 15 and 16 keep alternately opening and closing as conveyor 9 moves the successive line of baskets or fixtures out of the furnace 8.

Furnace 8, contains a bed of fluidized solids, 6, which in the preferred embodiment is fluidized foundry sand of the same composition and size ranges as was used to manufacture the sand cores. The baskets or fixtures 10, containing the parts 17, are passed through the bed of fluidized solids at a controlled rate.

The fluidizing air to create the fluidized bed of granular solids is typically ambient air pumped by blower 1, through air heater 2, and through distribution duct 3, which feeds the heated air to the plenum chamber 4, which comprises the contained volume under the fluidizing air distributor plate 5, and feeds the fluidizing air through distributor plate 5, which in turn accomplishes uniform distribution of the air into the fluidized solids thereby levitating the granular particles and creating the fluidized solids phenomenon.

The heated fluidizing air also provides the required energy to maintain and control the fluidized solids at the temperature required to debond the sand cores by thermally pyrolyzing or otherwise decomposing the sand core bonding agent which serves to maintain the sand cores as a hardened mass. When the bonding agent becomes thermally pyrolyzed or decomposed, the sand of the sand core becomes flowable and the sand granules flow from the casting and become mobile and part of the fluidized solids in the furnace. This thermal decomposition of the bonding agent is typically accomplished in the temperature range of 800° F. to 950° F. with the parts at temperature approximately 20 to 90 minutes depending upon the geometry and size of the parts involved.

The added foundry sand from the sand cores which flows into the fluidized bed is discharged from the furnace by overflowing through overflow pipe 20, typically located near or at the discharge end of the furnace and is then collected, cooled, optionally sieved, and is typically ready for reuse.

In a typical continuous process, the sand from the sand cores which add to the fluidized solids of the furnace are a relatively small part of the total. Therefore, the residence time of the recovered debonded sand in the furnace is relatively long, typically 10 to 100 hours depending on the process details of the application. This extended period at elevated temperature, advantageously approximately 510° C., typically results in a very high quality recovered sand.

The fluidizing gas from the bed of fluidized solids 6, exits the furnace through duct 21, is then passed through an off-gas treatment, system 11, typically comprising a cyclone for particulate removal and an afterburner to oxidize any volatile organic carbon (VOC) compounds from the thermal decomposition of the sand core binding agent and then through an exhauster, 12, which maintains the fluidized bed furnace 7, under a slightly negative pressure, typically less than 0.5 inches w.c. and causes the fluidizing gas to exit the furnace system.

When the requirement for sand core debonding is subsequently followed by a solution annealing heat treating step, the same system shown in FIG. 2, may be employed for both steps with the exception that fluidized bed furnace 7 must be made sufficiently long to provide for the residence time requirements to accomplish both processing steps.

A major economic advantage to this approach is that during the sand core debonding step, the castings are heated to an elevated temperature which also results in simultaneous solution annealing. In most cases, the sand core removal residence time becomes part of the solution annealing time, thereby shortening the overall cycle time.

This advantage is significant when the temperature for thermal sand core debonding is equal to or close to that required for solution annealing as is the case when processing aluminum castings.

Referring to FIG. 3, the process of this invention can also be practiced using the volume; i.e., the freeboard, above the fluidized bed of the fluidized bed furnace as a hold zone for heat treating or preheating of the parts being processed.

This processing arrangement takes advantage of the fact that in a fluidized bed furnace, the fluidizing gas phase exiting vertically through the surface of the fluidized solids maintains the temperature in the volume as freeboard at a very uniform temperature because the exiting gas phase is at a very uniform temperature.

In addition, this gas phase is flowing at a reasonable velocity depending upon the size of particles forming the fluidized bed and therefore the resulting fluidizing velocity.

The arrangement in FIG. 3, is a two tier conveyor system with parts being conveyed through the fluidized bed in one direction and then elevated at the end of the bed and returned in the other direction above the bed. In FIG. 3, parts analogous to those described in FIG. 2 are identified with similar numerals followed by a prime symbol.

In the processing example shown in FIG. 3, the cast parts enter the furnace through automatic door 14' into vestibule 18' and then through door 13' into fluidized bed furnace 8' with the alternating cycle of these two doors forming vestibule 18' which prevents furnace atmosphere and the environmental atmosphere from freely interchanging.

The fixtured parts 17' in basket or fixture 10' are conveyed by chain conveyor 9' through the fluidized bed at the required temperature to perform the sand core debonding.

At the far end of the furnace, the portion 21 of the conveying chain runs vertically and then returns in the opposite direction see portion 22'.

When the fixtured parts reach the end position 25', elevator 23' lifts the basket or fixture to the upper level of the chain 22' and it is then conveyed horizontally to exit door 15'.

During this passage above the fluidized bed, the castings are maintained at constant temperature and are thereby solution annealed.

The fixtured parts then exit the furnace through door 15', vestibule 19' and exit door 16'.

The processing strategy of fluidizing air and off-gas discharge as shown is the same as described for FIG. 2.

The advantages of this two-tier fluidized bed processing approach include:

1. High energy efficiency per part processed. The fluidizing gas maintains the temperature in the fluidized bed and is used a second time at the same temperature in the freeboard volume.

2. The size of furnace for a given capacity is significantly reduced in length, which reduces the cost of the furnace per part processed and this applies equally to some of the accessory parts of the processing system.

It is noted that the processing scheme shown in FIG. 3, can be applied to preheating parts for a sand core debonding process which does not require a heat treating process by reversing the direction of the conveyor chain 9', 24' and 22' portion.

In this processing arrangement, the fixtured parts at ambient temperature enter the furnace through door 16', vestibule 19' and door 15'.

The fixtured parts pass over the fluidized bed conveyed by chain section 22' from the feed point to end position 26'. While traversing this path, the parts are elevated in temperature from ambient or above ambient to the temperature required for sand core debonding.

From position 26', the fixtured part is lowered by elevator 23' to the lower chain section 9', thereby submerging it into the fluidized bed.

The fixtured parts are conveyed through the fluidized bed by chain section 9' and exit the furnace through door 13', vestibule 18' and door 14'. The sand core debonding process is accomplished during this period with the fixtured parts in the fluidized bed at temperature for the required residence time.

The following example involving aluminum automotive engine parts was performed in a pilot plant operation which simulated the process of this invention. The example describes the manner and process of making and using the invention and sets forth the best mode contemplated for carrying out the invention but is not to be construed as limiting.

EXAMPLE

Parts:

Aluminum castings/Engine blocks 5500 Kg/hr.

Sand Core Debonding Conditions:

Temperature: 500° C.

Residence Time: 90 minutes

Environment:

Fluidized Solids/Foundry Sand

Heat Treating Conditions:

Temperature: 500° C.

Residence Time: 5 hrs.

This was total time including the 90 minutes of sand core debonding. Both operations were conducted in the same furnace in series.

Quench:

Rapid quench to 200° C. in a fluidized solids bed of foundry sand. Fluidized solids cooled using water cooling coils.

Aging:

3 hrs. at 230° C. in fluidized bed aging furnace

Ambient Air Cooling to 60° C.

Heat Treating Results:

Blocks achieved a Brinell Hardness of 93–109.

Finally, it should be understood that the preferred embodiments of this process have been disclosed by way of examples, and that other modifications may occur to those skilled in the art without departing from the scope and spirit of the invention.

What is claimed:

1. A continuous process for the removal of sand cores from the internal passages and cavities of a plurality of metal castings formed by the sand cores, said sand cores being comprised of sand and a binder to maintain a required form and hardness of the sand core, said binder being thermally decomposed at an elevated temperature, which comprises;

providing a fluidized bed furnace, having a bed formed of fluidized sand maintained at a temperature sufficient to thermally decompose the binder and a freeboard space above the bed;

continuously passing in sequence through the furnace, submerged in the fluidized sand, a series of individual and separate metal castings containing the sand cores, said passing being at a speed to maintain individual castings in the series submerged for a period of time sufficient to thermally decompose the binder;

whereby sand from the cores, free of binder, flows freely from the individual casting to assimilate with the fluidized sand in the furnace bed.

2. The process of claim 1 wherein the temperature of the fluidized sand is maintained by heating ambient air to a temperature above the maintenance temperature and distributing the heated ambient air to the bottom of the fluidized sand bed.

3. The process of claim 1 wherein the passing metal castings are subsequently heat treated.

4. The process of claim 3 wherein the binder is decomposed simultaneously with the heat treatment.

5. The process of claim 3 wherein the heat treatment comprises solution annealing.

6. The process of claim 4 wherein the heat treatment comprises solution annealing.

7. The process of claim 1 which further comprises continuously quenching the individual and separate metal castings upon their emergence from the fluidized bed, whereby a required hardness is achieved.

8. The process of claim 3 which further comprises continuously quenching the individual and separate metal castings upon their emergence from the fluidized bed, whereby a required hardness is achieved.

9. The process of claim 4 which further comprises continuously quenching the individual and separate metal castings upon their emergence from the fluidized bed, whereby a required hardness is achieved.

10. The process of claim 5 which further comprises continuously quenching the individual and separate metal castings upon their emergence from the fluidized bed, whereby a required hardness is achieved.

11. The process of claim 10 which further comprises aging the quenched metal castings at an elevated temperature in a fluidized bed furnace.

12. The process of claim 8 which further comprises aging the quenched metal castings at an elevated temperature in a fluidized bed.

13. The process of claim 9 which further comprises aging the quenched metal castings at an elevated temperature in a fluidized bed.

14. The process of claim 10 which further comprises aging the quenched metal castings at an elevated temperature in a fluidized bed.

15. The process of claim 1 wherein the individual and separate metal castings containing sand cores are pre-heated before passing continuously into the fluidized bed furnace.

16. The process of claim 15 wherein pre-heating is carried out by continuously passing the metal castings containing sand cores through the fluidized bed furnace freeboard above the bed.

17. The process of claim 1 wherein the metal is aluminum.

18. The process of claim 1 where the recovered foundry sand from the sand cores is maintained at a temperature of approximately 510° C. for long residence times of 10 hours to more than 100 hours to eliminate organic continuation.

* * * * *